US005422956A

United States Patent [19]

Wheaton

[11] Patent Number: 5,422,956

[45] Date of Patent: Jun. 6, 1995

[54] SOUND PARAMETER CONTROLLER FOR USE WITH A MICROPHONE

[75] Inventor: James A. Wheaton, Fairfax, Calif.

[73] Assignee: Yamaha Corporation, Japan

[21] Appl. No.: 866,898

[22] Filed: Apr. 7, 1992

[51] Int. Cl.[6] ..... H04R 3/00

[52] U.S. Cl. ..... 381/122; 381/61; 84/741

[58] Field of Search ..... 381/92, 95, 61, 122, 381/111, 113, 114, 115; 84/741, 738, DIG. 12

[56] References Cited

U.S. PATENT DOCUMENTS

| | | | |
|---|---|---|---|
| 4,341,140 | 7/1982 | Ishida | 84/711 |
| 4,463,650 | 8/1984 | Rupert | 84/654 |
| 4,776,253 | 10/1988 | Downes | 84/645 |
| 4,817,153 | 3/1989 | Fernandez | 381/92 |
| 5,117,730 | 6/1992 | Yamauchi | 84/742 |
| 5,267,320 | 11/1993 | Fukumizu | 381/71 |

FOREIGN PATENT DOCUMENTS

| | | |
|---|---|---|
| 63-38631 | 10/1988 | Japan . |
| 292897 | 7/1990 | Japan . |

OTHER PUBLICATIONS

Catalog sheet for a Sony microphone named Variety Mic.

*Primary Examiner*—Curtis Kuntz
*Assistant Examiner*—Ping W. Lee
*Attorney, Agent, or Firm*—Graham & James

[57] ABSTRACT

A microphone is provided with sensors to detect pitch and roll of the microphone and pressure applied to the microphone. The sensor signals are mapped by control circuitry to control desired effects such as reverberation, vibrato and tremolo to be applied to the audio signal from the microphone or to control effects or other parameters such as volume and tempo in an accompaniment musical instrument. Both the effect to be imparted and the degree of the effect can be controlled based upon signals from the sensors.

27 Claims, 3 Drawing Sheets

SOUND PARAMETER CONTROLLER FOR USE WITH A MICROPHONE

BACKGROUND OF THE INVENTION

1. Field of the Invention

The present invention relates to microphones and more particularly to microphones having the capability to impart special effects to the audio signal which is outputted from a microphone.

2. Description of the Prior Art

In general, microphones perform the function of transducing a performer's voice or other sound into an electrical audio signal for amplification and sounding through a speaker system or for recording on a tape recorder or the like.

It is often desirable to impart various special effects to an audio signal which has been picked up by a microphone, particularly in a live performance situation. For example, a performer may wish to add a special effect such as reverberation or tremolo so as to add interest to the performance. Typically, this is accomplished by providing the audio signal from the microphone to an effects device and operating various switches and controls on the special effects device to impart the desired effects to the audio signal. It is also known to provide switches on the body of a microphone to enable the performer to select the effect to be imparted. Providing switching capability on the body of the microphone eliminates the need for the performer to go to an effects unit each time it is desired to change effects.

Although microphones with switches to control the imparting of effects eliminate the need to manipulate controls on a separate effects unit, they do not provide any improvement in the actual manner in which effects are imparted, i.e., they simply control the switching of effects.

SUMMARY OF THE INVENTION

The present invention is directed to a microphone in which actual movements of the performer holding the microphone are detected and employed to control the degree of various effects which are to be imparted to the audio signal from the microphone, or to control an accompanying musical instrument. A microphone is provided with one or more sensors to detect motion of the microphone and to provide control signals representative of the degree of motion. Motion parameters such as the degree of tilt of the body of the microphone relative to a reference axis and the degree of roll of the body of the microphone relative to a reference axis can be employed. The detected values can be applied to an effects unit to control the amount of particular effects to be imparted to the audio signal from the microphone. Examples of effects to be imparted to the audio signal or an accompaniment instrument include vibrato, reverberation, tremolo, chorus and volume. With respect to an accompaniment instrument, tempo may also be controlled. The system may be controlled so as to map a particular type of motion of the microphone so as to control a desired effect or parameter of a particular effect.

By providing a microphone with motion sensors, natural movements of a performer may be employed to control and vary effects to be imparted to the audio signal, thereby greatly increasing the performer's expressive capabilities. In contrast to a simple switching arrangement which provides an increase in operational convenience, the present invention greatly increases the expression capability of the performer.

BRIEF DESCRIPTION OF THE DRAWINGS

The invention will be described with reference to the accompanying drawings wherein.

DESCRIPTION OF THE PREFERRED EMBODIMENT

The following description is of the best presently contemplated mode of carrying out the invention. This description is made for the purpose of illustrating general principles of the invention and is not to be taken in a limiting sense. The scope of the invention is best determined by reference to the appended claims.

Figure 1:
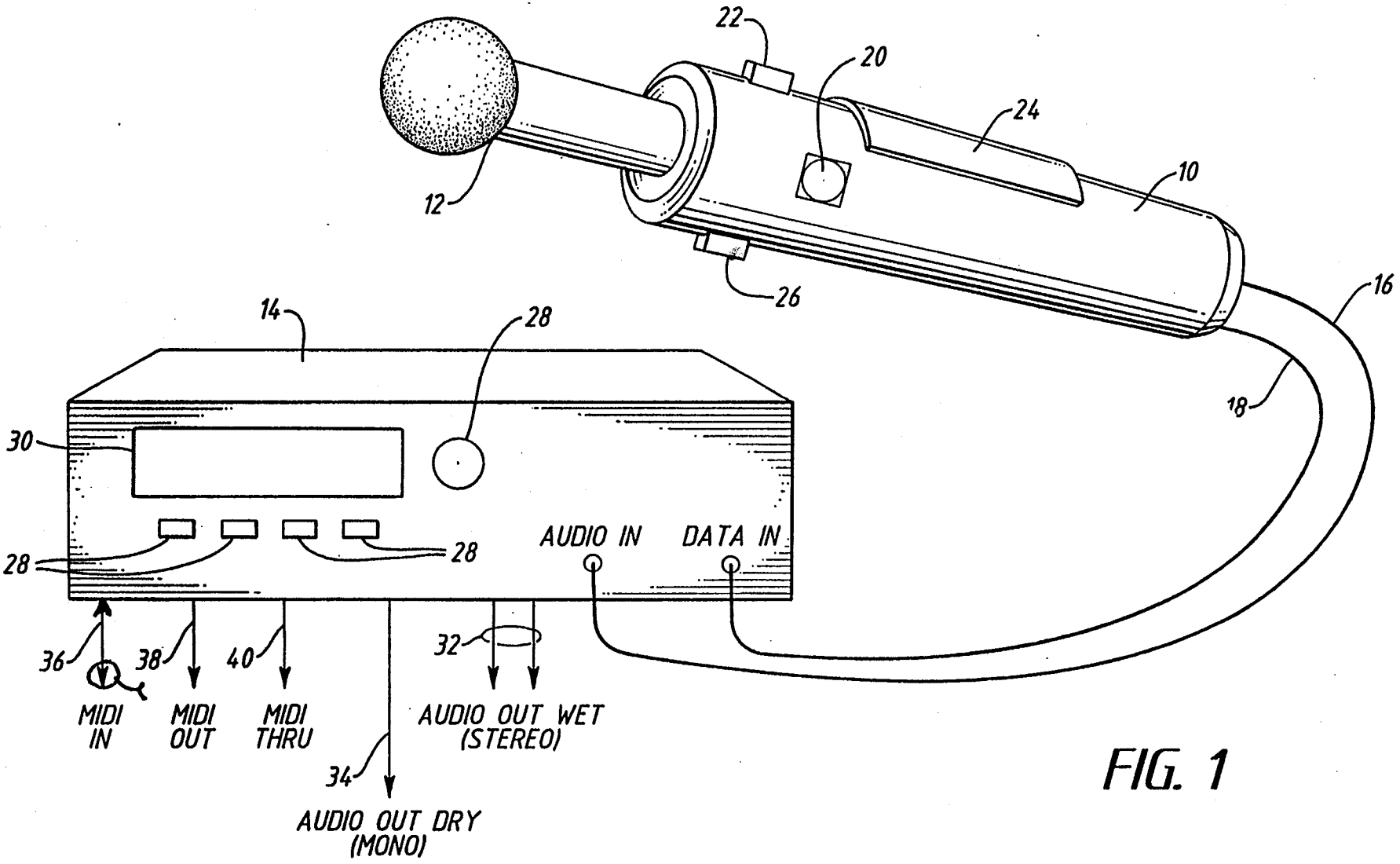
FIG. 1 is a perspective view of a microphone system according to the present invention.

The preferred configuration of the present invention is illustrated in FIG. 1. The system includes a collar unit 10 which is essentially formed of a cylindrical body having an interior space for receiving a microphone 12. Audio signals from the microphone and various data signals from the collar are provided to an electronics unit 14 via cables 16 and 18, respectively.

Various sensors are mounted on the collar 10 to provide signals representative of motion and gripping pressure. Specifically, a pitch inclinometer 20 is mounted on a side of the collar 10 to detect changes in pitch of the collar as will be discussed subsequently, a roll inclinometer 22 is positioned on a front portion of the collar 10 for detecting roll motion as will be discussed subsequently, and a grip pressure pad 24 is also positioned on the front of the collar to detect gripping pressure. A switch 26 is provided on a rear portion of the collar 10 and is activated to freeze current values from the sensors 20, 22 and 24 so as to maintain imparted effects constant. Signals from the sensors 20, 22 and 24 and the switch 26 are provided to the electronics unit 14 via the data cable 18. The provision of the collar separate from the microphone facilitates use with various different microphones; however, a microphone could be provided with the necessary sensors integral with its body.

The electronics unit 14 includes various operating members 28 which are used to control the programming or mapping of various motions to different effects, and a display 30 which is used in conjunction with the members 28. The electronics unit 14 may provide a mono or stereo output 32 which corresponds to the audio signal from the microphone with various effects imparted to it. The basic unmodified audio signal from the microphone may also be provided via an output line 34. In, Out and Thru connections in accordance with the well-known MIDI (Musical Instrument Digital Interface) standard are also provided at lines 36, 38 and 40, respectively.

Figure 2:
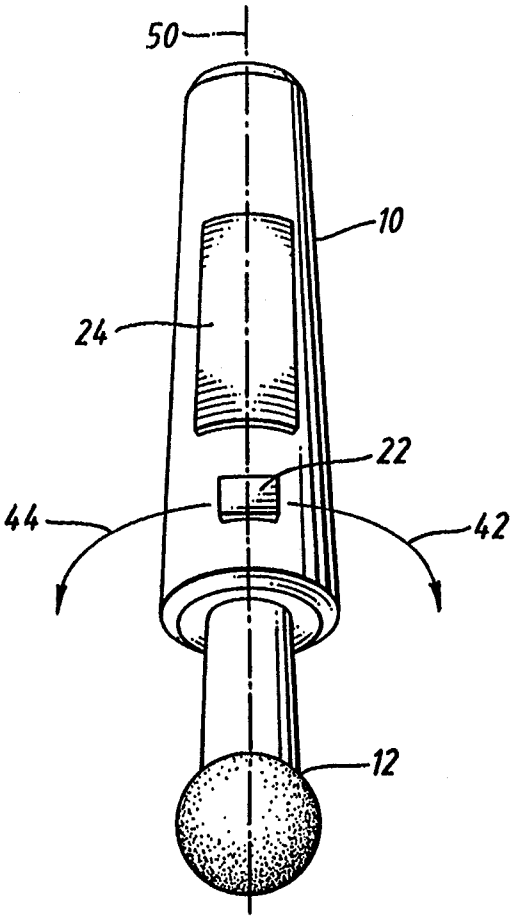
FIG. 2 is a perspective view illustrating the sensing of roll motion of the microphone for controlling effects.

An example of the functioning of the microphone system of the present invention will be illustrated with reference to FIGS. 2 and 3. When a performer uses the microphone 12, he or she will grasp the collar 10 about a grasping axis 50, i.e., the major axis of the microphone 12. The user will grasp the collar such that the sensor 22 faces away from the user. By twisting his or her wrist, the performer can cause the collar and microphone to roll about the axis 50 in either a positive direction as indicated by arrow 42 or a negative direction indicated by arrow 44. The sensor 22 provides a signal output indicative of the direction and amount of roll from a predetermined reference position. The electronics unit 14 may be appropriately programmed to impart one or more effects to the audio signal generated from the microphone in an amount determined by the degree of roll. For example, the unit could be programmed such that roll in the positive direction from the middle neutral position increases a parameter relating to vibrato such as oscillation speed, whereas roll in the negative direction from the middle neutral position could cause an increase in a chorus effect. Alternatively, a single parameter or effect may be controlled over the entire range of motion. The pressure sensor 24 may be used to control a related parameter which is controlled by roll, e.g., increasing pressure could cause an increase in vibrato depth, or can be used to control an independent effect or parameter.

Figure 3:
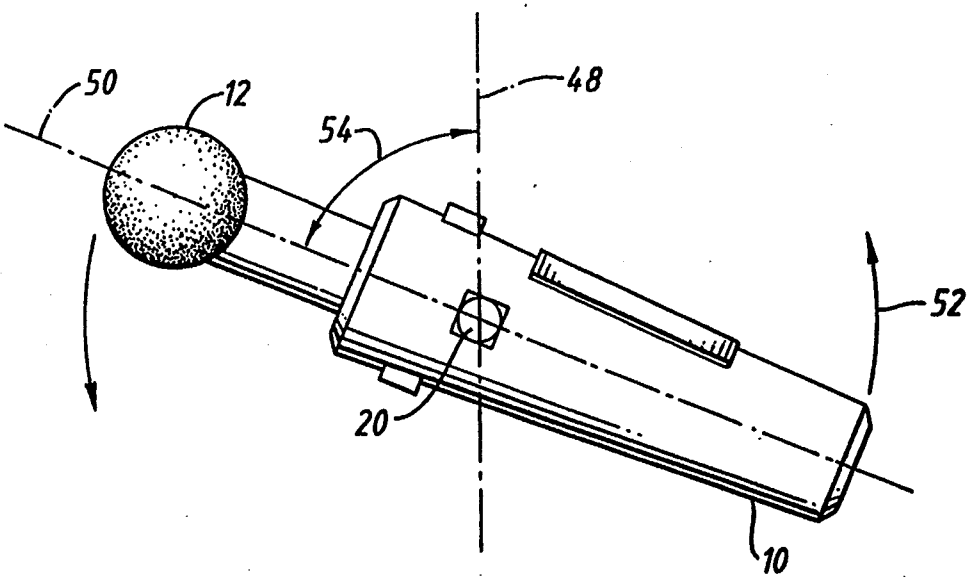
FIG. 3 is a plan view illustrating the sensing of pitch motion for controlling effects.

Control of effects in accordance with pitch variation is illustrated in FIG. 3. The sensor 20 is configured to provide an output signal representative of the degree of tilt of the grasping axis 50 of the collar 10 and microphone 12 with respect to a vertical axis 48. Imparting a positive pitch to the microphone as illustrated by an arrow 52 may, for example, be employed to increase a reverberation effect to be imparted to the audio signal from the microphone, whereas decreasing the pitch toward vertical will cause the reverberation effect to be reduced. The angle 54 between the grasping axis 50 and the vertical axis 48 will determine the degree of effect to be imparted.

From the foregoing, it will be appreciated that natural movements of the performer in association with holding the microphone may be used to control the amount of various effects to be imparted to the signal from the microphone, thereby providing the performer with greatly increased expression capability. Various motions can be mapped to different effects to provide an almost unlimited control of various effects in response to different motions.

Figure 4:
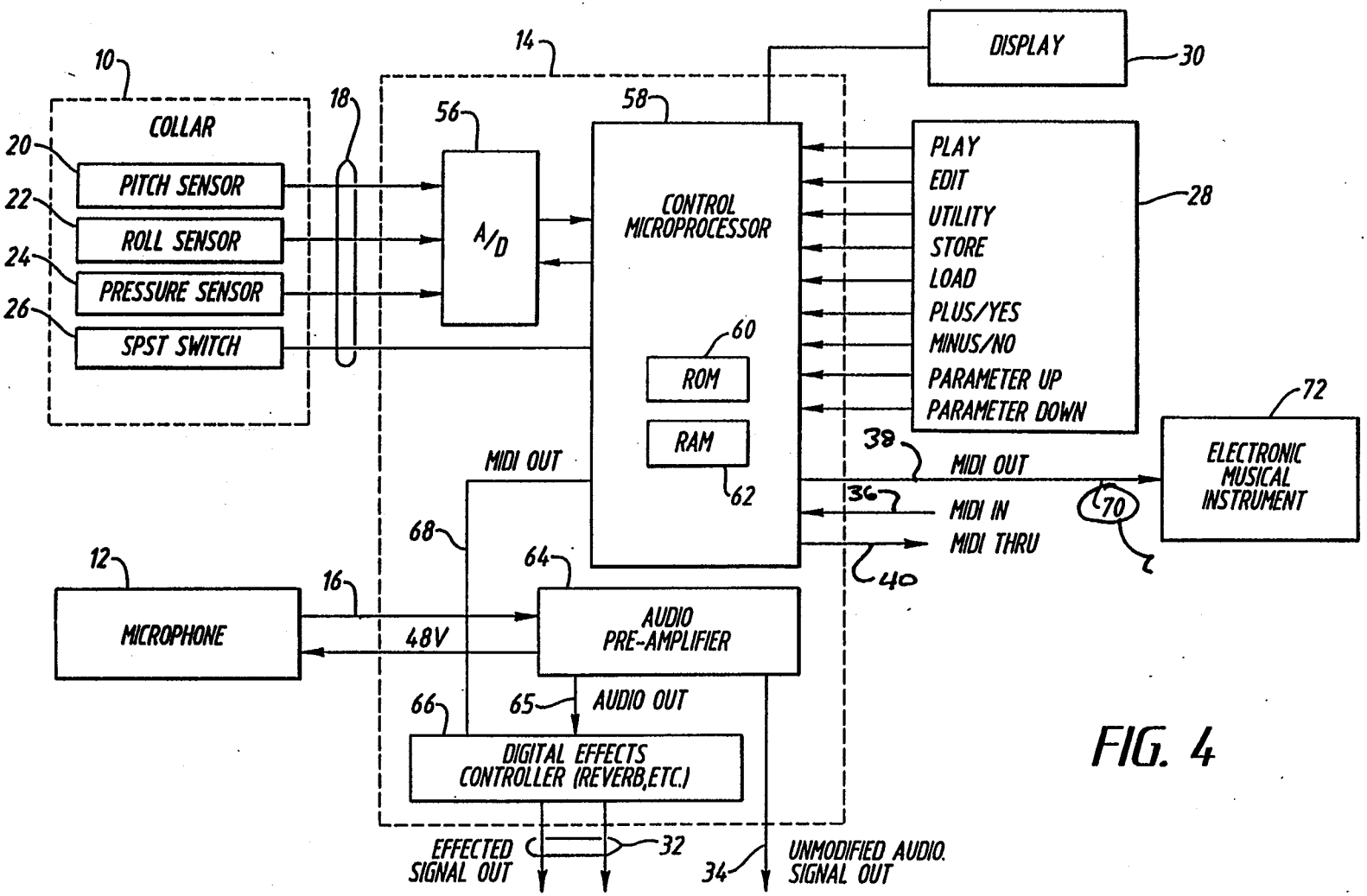
FIG. 4 is a block diagram of the microphone system of the present invention.

Referring to FIG. 4, the electronics section 14 includes an analog-to-digital converter 56 which receives analog signals from the sensors 20, 22 and 24 and converts them into digital signals. These signals are provided to a control microprocessor 58 which includes a program ROM 60 and a working RAM 62. The control microprocessor 58 receives signals from the sensors 20, 22 and 24 via the analog-to-digital converter 56, a switching signal from the switch 26, and programming control signals from the operating members 28. Exemplary programming switches are illustrated in FIG. 4; however, many different control configurations could be implemented. The manner of programming the system to provide the desired mapping between motion and effects will be discussed subsequently.

The audio signal from the microphone 12 on line 16 is provided to an audio preamplifier 64 contained within the electronics unit 14. The unmodified audio signal is provided on the output line 34. In addition, the audio output signal is provided to a digital effects controller 66 via a line 65. The effects circuitry may include various effects circuits well known in the art and may provide various digital effects such as reverberation, chorus, vibrato, tremolo and others. The audio signal from the microphone which has been imparted with the desired digital effect is provided as an effected signal out, which may be either mono or stereo (certain effects by their nature create a stereo signal from a mono input).

The effects which are imparted by the digital effects controller 66 are determined by control signals received from the control microprocessor 58 via line 68. In the preferred embodiment of the invention, standard MIDI control signals are provided, although non-standardized signals could be employed.

The primary function of the control microprocessor 58 is to receive the motion and pressure signals from the various sensors, map them to desired degrees of desired effects and provide appropriate effect control signals to the digital effects controller 66 via the control line 68. Each type of sensor has an output range. Output ranges for the inclinometer sensors 20 and 22 are given in degrees. Output ranges for the force sensor are given in terms of a percentage of a pre-determined maximum pressure (psi). The output ranges run from an absolute minimum to an absolute maximum. In the case of the pitch sensor, the minimum output represents zero degrees (vertical) and the maximum output represents 180 degrees (the mouthpiece of the microphone pointing down). With respect to the roll sensor 22, the minimum output is −90° (counterclockwise motion) and the maximum output is +90° (clockwise motion). With respect to the pressure sensor 24, the minimum output is 0% (low pressure) and the maximum output is 100% (high pressure).

The user can set a "working" output range for each sensor. This effectively limits the output of the sensor to the new range, which is less than the absolute range. For example, the user can define the working range of the pitch sensor to be from a minimum of 45° to a maximum of 135°. When the working range for each sensor is set, the sensor will only produce a musical effect when it is outputting a value within its working range. By this control, the user can effectively set a slack zone of motion in which effects will not be imparted, thereby avoiding inadvertent addition of effects. In addition, the "working" range allows the singer to produce a maximum control signal in response to a small amount of movement. Thus, small movements can have a big effect.

As discussed above, the musical effects which can be controlled by the sensor outputs are quite varied. The user selects what type of musical effect is to be imparted by means of programming via the operating members 28. For each musical effect which the user wishes to control, a mapping of sensor range to musical effect range must be made. The musical effect range limits the output of the musical effect to within a maximum and minimum value. In the following examples, it is assumed that MIDI is being employed to control the musical effect. The first step in selecting a mapping is to select which sensor is to be used, and to limit the sensor to a working range. For example, the pitch sensor 20 may be first selected and its operation limited to a minimum of 90° and a maximum of 135°, i.e., no effect will be imparted until the microphone is tilted 90° from vertical and the effects will only be imparted within the range in which the microphone is tilted between 90° and 135°.

After the working range of the sensor has been chosen, the desired musical effect to be controlled by the sensor is selected. The processor 58 may present these choices as words to the display 30, or as specific MIDI command types. In the present example, it is assumed that MIDI command types are the choices and the mapping choice for the pitch sensor is control of MIDI volume, i.e., the volume of the signal from the microphone will be controlled dependent on the angle of the pitch sensor 20.

After the mapping between sensor and musical effect is chosen, the range of output values of the controlled musical effect is selected. For MIDI implementations, the range is generally from a minimum of zero to a maximum of 127. In the present example, it is desired that the pitch sensor 20 be employed to control the volume in the range of 100 to 127. Thus, the overall mapping function is summarized as shown in Table I.

TABLE I

| | |
|---|---|
| Sensor Type: | Pitch |
| Sensor Range: | 90°–135° |
| Effect Type: | MIDI Volume |
| Effect Range: | 100–127 |

The mapping algorithm which converts an input value from a sensor to an output value representative of control of a particular effect will now be described. The description is given in pseudo-code. Pseudo-code is a way to represent computer implementations of algorithms without having to follow the normally stringent syntactic requirements of computer language compilers. First, the variables which must exist before the algorithm can be run are defined:

```
X = Sensor Output Value
InputMin = Sensor Working Range Minimum Value
InputMax = Sensor Working Range Maximum Value
OutputMin = Musical Effect Output Minimum Value
OutoutMax = Musical Effect Output Maximum Value
The algorithm includes the following steps:
Step 1: Clip the Sensor Output Value to within the Working
        Range.
          if (X < InputMin) then X = InputMin;
          if (X > InputMax) then X = InputMax;
Step 2: Compute the relative position of X within the
        Working Range. This can be thought of as a
        percentage, and is a value between zero and one,
        computed by dividing X by the Working Range.
          InputRange = InputMax - InputMin;
          InputPercentage = (X - InputMin)/InputRange;
Step 3: Compute the Output range.
          OutputRange = OutputMax - OutputMin;
Step 4: Compute the Output Value, which is the value within
        the output range which is represented by the
        InputPercentage.
          OutputValue = OutputMin + (InputPercentage *
          OutputRange);
```

This OutputValue is the final result of the mapping algorithm. In the present example, it would correspond to the mapping of some number between 90 and 135 to some number between 100 and 127. As an example, if the pitch sensor 20 were sending an output value of 110 degrees, then the control microprocessor 58 would send a MIDI volume message to the effect circuit with a value of 112.

By defining different mappings, more than one type of musical effect can be in operation at the same time. For example, when using MIDI as the control language, the same sensor type can be mapped onto different musical effect types with different ranges. Thus, when the sensor detects a roll value between −90° and 0°, it can produce a type of vibrato effect, but when it detects a roll value of between 0° and 90°, it can produce a type of chorus, or doubling, effect. The sensor ranges can also overlap, such that for some sensor values, more than one musical effect is being controlled. The only theoretical limit to how many musical effects can be used at once is the limit on throughput of the electronic control circuitry. Of course, in practice, it is hard for performers to control more than a handful of effects at the same time.

The present invention is not limited to the imparting of effects to the audio signal from the microphone. Alternatively, the effect control signals can be provided via an output line (in the preferred embodiment a MIDI out line 38) to control an accompaniment instrument such as an electronic musical instrument 72 or an automatic performance piano which has MIDI capability. The instrument 72 would be employed to provide accompaniment to the performer who is using the microphone, and the performer can advantageously control various parameters of the accompaniment such as volume and tempo in accordance with motion of the microphone and pressure applied to the pressure sensor. It is also possible to control both an external instrument and the internal digital effects controller 66 to impart desired effects to the performer's voice in addition to controlling the external instrument.

Although FIG. 4 illustrates a digital effects controller which is internal to the control circuitry 14, the system can be configured so as to not include such a controller and rather to simply provide effects control signals to an external effects device or mixing device. The audio signal from the microphone would also be provided to the external effects device to have the desired effects imparted to it.

Various different types of sensors can be employed with the present invention. With respect to the pressure sensor 24, the preferred type of sensor is a force sensitive resistor (FSR) which provides an output voltage proportional to the amount of pressure applied to the resistor. With respect to the inclinometers, several types of sensors can be successfully employed. The microphone system relies upon knowing the angle of tilt of the microphone in two different orthogonal planes, previously referred to as pitch and roll. In one embodiment, the pitch and roll sensors 20 and 22 which are employed are magnetic wave location sensors which detect three different magnetic wave frequencies broadcast by a separate source antenna. The pitch and roll signals are provided based upon the detected magnetic signals. Such sensors provide accurate orientation signals; however, they are expensive and the magnetic signals employed can cause audible interference with sensitive audio amplifiers and effects units. The sensors also have a somewhat limited range (in distance from the source antenna).

A second type of inclinometer employs a capacitive-based sensor which provides output signals directly proportional to the relative tilt of two axes at right angles to each other. Such sensors have a relatively slow settling time. Since most motions made with the microphone will be slow, this type of sensor will normally provide acceptable performance. However, it may produce unpredictable results when moved too quickly.

Yet another type of sensor employs an electrolytic fluid to provide tilt measurement. This type of sensor is commonly used in airplane and missile guidance systems. Sensors of this type are typically very small and accurate, but may also have some problems of slow settling time.

The above types of sensors are exemplary only and various types of sensors could be employed with the present invention to provide the necessary inclination signals employed to control various musical effects.

Various modifications can be made to the invention without departing from the scope of the invention. For example, although the microphone is illustrated as being coupled to the electronics unit via wire connections, a wireless microphone could be employed, in which both the audio signal and the sensor signals are transmitted via radio signals. In addition, the control circuitry may be provided with a power source in order to provide power to certain types of microphones, such as condenser microphones.

The present invention thus provides the ability to greatly enhance the expression capability of a performer using a microphone. Natural movements of the microphone by the performer can be used to control the selection of various effects to be imparted and the degree of effects to be imparted, either to the audio signal from the microphone and/or to an accompaniment instrument.

What is claimed is:

1. A sound parameter controller for use with a microphone, comprising:

a motion sensor coupled to the body of a microphone and moved in conjunction with the microphone body for detecting the spatial angular orientation of the microphone, said sensor providing a sensor output signal in response to movement of the microphone body by a performer; and control means for receiving the sensor output signal and generating a parameter control signal in response thereto, wherein said parameter control signal controls a parameter of an effect to be imparted on an audio signal, whereby the effect can be controlled by the performer in a desired fashion by moving the microphone.

2. A parameter controller as in claim 1 wherein said audio signal is transduced from a sound received by the microphone, further including means for providing the control signal to an effect imparting device which receives the audio signal, so as to control the effect imparted to the audio signal provided from the microphone.

3. A parameter controller as in claim 2 further including said effect imparting device, contained in a common housing with the control means, which receives the audio signal from the microphone and the control signal from the means for providing and imparts the effect to the audio signal in accordance with the control signal.

4. A parameter controller as in claim 1 wherein the microphone provides an audio signal distinct from the audio signal to which the effect is imparted and wherein the controller includes output means for providing the control signal to an external effect imparting device for imparting the effect.

5. A parameter controller as in claim 1 further including hand-held support means for detachably supporting a microphone, wherein the motion sensor is secured to the support means.

6. A parameter controller as in claim 5 wherein the support means includes a generally cylindrical hollow collar into which the body of a microphone is inserted.

7. A parameter controller as in claim 1 including at least one additional motion sensor, wherein each sensor is configured to respond to a different type of motion of the microphone body and provide a separate sensor output signal, wherein the control means receives the plural output signals from the sensors and generates a corresponding plurality of parameter control signals to control different parameters with respect to one or more effects to be imparted to said audio signal.

8. A parameter controller as in claim 7 further including a pressure sensor coupled to the body of the microphone and providing an output signal responsive to grasping pressure of the performer when holding the microphone, wherein the control means also receives the pressure sensor output signal and generates an additional parameter control signal in response thereto, thereby to enable an additional effect to be imparted to the audio signal.

9. A parameter controller as in claim 1 further including a pressure sensor coupled to the body of the microphone and providing an output signal responsive to grasping pressure of the performer when holding the microphone, wherein the control means also receives the pressure sensor output signal and generates an additional parameter control signal in response thereto, thereby to enable an additional effect to be imparted to the audio signal.

10. A parameter controller as in claim 7 wherein said different types of motion of the microphone body to which the motion sensors respond include a change in pitch with respect to a grasping axis of the body and roll motion of the body about the grasping axis.

11. A parameter controller as in claim 1 including switch means for providing a signal to the control means to cause the parameter control signal to be held at its current value despite any change in the sensor output signal.

12. A parameter controller as in claim 1 wherein the sensor output signal is an analog signal and wherein the control means includes an analog-to-digital converter for converting the sensor output signal to a digital signal and digital processing means for generating a digital parameter control signal in response to the sensor output signal.

13. A parameter controller as in claim 1 wherein the motion sensor is positioned to provide an output signal indicating a continuous change in pitch of the body of the microphone with respect to a grasping axis of the body.

14. A parameter controller as in claim 1 wherein the motion sensor is positioned to provide an output signal indicating a roll motion of the body of the microphone about a grasping axis of the body.

15. A parameter controller as in claim 1 wherein the motion sensor is comprised of an inclinometer for sensing the relative orientation of the microphone body with respect to a reference orientation.

16. A microphone system comprising:

a microphone providing an audio output signal and having a body and a grasping axis;

a first motion sensor coupled to the body to move in conjunction therewith for detecting the spatial angular orientation of the microphone, said sensor providing a first varying sensor output signal in response to movement of the microphone body by a performer who grasps the body about the grasping axis;

control means for receiving the first sensor output signal and generating a first parameter control signal in response thereto; and effect imparting means for receiving the audio output signal from the microphone and the first parameter control signal and imparting an effect to the audio signal in accordance with the first parameter control signal.

17. A microphone system as in claim 16 wherein the effect imparting means imparts a vibrato effect to the audio signal.

18. A microphone system as in claim 16 wherein the effect imparting means imparts a reverberation effect to the audio signal.

19. A microphone system as in claim 16 wherein the effect imparting means imparts a chorus effect to the audio signal.

20. A microphone system as in claim 16 wherein the effect imparting means imparts a volume control to the audio signal.

21. A microphone system as in claim 16 further including a second motion sensor coupled to the body to move in conjunction therewith, said second sensor providing a second varying sensor output signal in response to a different type of movement of the microphone body, wherein the control means receives the second sensor output signal and generates a second parameter control signal in response thereto, and wherein the effect imparting means imparts at least one effect to the audio signal in accordance with the first and second parameter control signals.

22. A microphone system as in claim 21 wherein the first and second parameter control signals relate to different parameters of a single effect to be imparted to the audio signal.

23. A microphone system as in claim 21 wherein the first and second parameter control signals relate to parameters of two different effects to be imparted to the audio signal.

24. A microphone system comprising:

a microphone providing an audio output signal and having a body and a grasping axis;

a first motion sensor coupled to the body to move in conjunction therewith for detecting the spatial angular orientation of the microphone, said sensor providing a first varying sensor output signal in response to movement of the microphone body by a performer who grasps the body about the grasping axis;

control means for receiving the first sensor output signal and generating a parameter control signal in response thereto; and an accompaniment musical instrument for receiving the parameter control signal, wherein a parameter of an effect to be imparted on an audio signal of the accompaniment musical instrument is controlled in response to the parameter control signal.

25. A microphone system as in claim 24 wherein the controlled parameter of the accompaniment musical instrument is volume.

26. A microphone system as in claim 24 wherein the controlled parameter of the accompaniment musical instrument is tempo.

27. A sound parameter controller for use with a microphone, comprising:

at least two motion sensors coupled to the body of a microphone and moved in conjunction with the microphone body for detecting to spatial angular orientation of the microphone, said sensors providing variable sensor output signals in response to movement of the microphone body by a performer in any direction; and control means for receiving the sensor output signals and generating parameter control signals in response thereto, wherein said parameter control signals individually control a parameter of an effect to be imparted on an audio signal, whereby the effect can be controlled by the performer in a desired fashion by moving the microphone.

* * * * *